US012442615B2

(12) United States Patent
Barnes

(10) Patent No.: US 12,442,615 B2
(45) Date of Patent: Oct. 14, 2025

(54) HYPER-MAGNETIC MATTER ACCELERATOR

(71) Applicant: Peter Gregory Barnes, Calhan, CO (US)

(72) Inventor: Peter Gregory Barnes, Calhan, CO (US)

( * ) Notice: Subject to any disclaimer, the term of this patent is extended or adjusted under 35 U.S.C. 154(b) by 0 days.

(21) Appl. No.: 18/324,208

(22) Filed: May 26, 2023

(65) Prior Publication Data

US 2024/0125574 A1 Apr. 18, 2024

Related U.S. Application Data

(60) Provisional application No. 63/369,408, filed on Jul. 26, 2022.

(51) Int. Cl.
*F41B 6/00* (2006.01)

(52) U.S. Cl.
CPC ..... *F41B 6/003* (2013.01)

(58) Field of Classification Search
CPC ..... F41B 6/00; F41B 6/003; F41B 6/006
USPC ..... 89/8; 124/3
See application file for complete search history.

(56) References Cited

U.S. PATENT DOCUMENTS

| | | | | |
|---|---|---|---|---|
| 3,611,783 | A * | 10/1971 | Mittelmann | B21J 7/30 89/8 |
| 4,432,333 | A * | 2/1984 | Kurherr | F41B 6/00 89/8 |
| 4,480,523 | A * | 11/1984 | Young | F41B 6/006 89/8 |
| 5,158,291 | A * | 10/1992 | Biagi | F41B 6/00 273/127 R |
| 5,483,863 | A * | 1/1996 | Dreizin | F41B 6/006 89/8 |
| 8,237,526 | B2 * | 8/2012 | Putman | F41J 13/00 335/282 |
| 8,302,584 | B1 * | 11/2012 | Lu | F41B 6/003 124/3 |
| 9,476,668 | B1 * | 10/2016 | Grace | F41A 1/02 |
| 10,928,157 | B1 * | 2/2021 | Busch, II | H05H 15/00 |
| 2003/0137377 | A1 * | 7/2003 | Engel | F41B 6/003 335/220 |
| 2020/0340775 | A1 * | 10/2020 | Zhou | H01F 7/064 |
| 2021/0148670 | A1 * | 5/2021 | Busch, II | H05H 7/22 |
| 2024/0125574 | A1 * | 4/2024 | Barnes | F41B 6/003 |

* cited by examiner

*Primary Examiner* — Samir Abdosh

(57) ABSTRACT

The Hyper-Magnetic Matter Accelerator comprises an apparatus and method of a plurality of basin-formed electromagnetic field generators as well as rotational electromagnetic field generators mounted in series to a conduit; energized in sequence for ferrous matter or projectile acceleration to, but not limited to or by high-hypersonic velocity and rotation for trajectory stabilization accuracy. Velocity control may be implemented through the use of various power levels as well as configuration by one skilled in the art based on said artisan's intended velocity objective.

1 Claim, 15 Drawing Sheets

HYPER-MAGNETIC MATTER ACCELERATOR

BACKGROUND

1. Field of Invention

The disclosed invention is in the field of Electromagnetic Launchers

2. State of the Art

The notion of using electromagnetic fields to give forward momentum to ferrous projectiles has been around for over a century. There are many examples of electromagnetic accelerators that may achieve a higher velocity on projectiles than combustion propellants, however, lack the means to cross into high-hypersonic and beyond speeds. Such examples include Coil-Guns, Gauss Rifles, Rail Guns, Mass Driver and Electromagnetic Catapults typically categorized as "Electromagnetic Launchers". As far back as 1904 the Electromagnetic Gun details use of electrically generated magnetic fields to accelerate a projectile in place of using combustible charge munition propellants. Therefore, what is clearly needed is an apparatus and method that can achieve high-hypersonic velocity and beyond.

DESCRIPTION

The following account will provide a comprehensive framework for the construction, methodical operation, and capabilities of the Hyper-Magnetic Matter Accelerator. While the below and claimed components are described with specificity, they are not to be taken as the only configuration of embodiments represented in the present invention. Preferred configuration may be determined by one skilled in the art for the intended outcome predicated on desired velocity and rotation without departing from the inventive core of the present invention.

Construction of one of the first embodiments representing the Hyper-Magnetic Matter Accelerator consists of a multitude of basin-formed electromagnetic field generators (10) comprised of basin-formed mounting scaffold (100) apparati that contain an aperture (102) at their wells and are designed to have mounting slots (104) in which are installed a plurality of electromagnetic coils (106) in which electromagnetic field generating wiring (200) is used. Mounting slots (104) of the basin-formed scaffold are arranged in alternatingly spaced radial pattern columns. Construction of another embodiment can be represented by rotational electromagnetic field generators (12) that may be installed alternatingly between the first embodiments around a conduit (14) and could be bracketed by thermal railing (16). Rotational electromagnetic field generators (12) can be represented by any amalgamation of electromagnetic field generating wiring (200), electromagnetic coil (106) or plurality thereof whose generated electromagnetic field/s physically rotate (30) providing a spin on ferrous material or projectile's longitudinal axis. The basin-formed electromagnetic field generator's (10) electromagnetic coils (106) can be installed with their respective electromagnetic north or south poles all oriented in the same direction to point to the spherical center of the basin scaffold's flared concave well. Both embodiments may be placed in succession encircling said conduit (14). There may be many different types of quick power release sources as well as power storage sources along with control interfaces capable of energizing the components in succession which will enable the aforementioned capabilities of the Hyper-Magnetic Matter Accelerator. Once the Basin Formed Electromagnetic Field Generator is energized, it will produce a basin-formed electromagnetic field (20). Said field will further form a compressed electromagnetic hemisphere (22) slightly above said scaffold's aperture's rim on the concave side. An electromagnetically compressed cap (24) is molded at the top of the electromagnetic hemisphere. Said cap is where the maximum electromagnetic forward momentum force (28) is produced. A toroid-shaped electromagnetic field (26) is also created inside the aperture on the convex side. Electromagnetic material wire (200) is needed for winding the electromagnetic coils (106) as well as rotational electromagnetic field generator assembly. The basin-formed electromagnetic field generator (10) may be oriented around the conduit with its convex or concave shape facing forward or backward, however, concave forward produces the maximum electromagnetic forward momentum force (28) as the compressed electromagnetic hemisphere's cap (24) produces more forward momentum force than the convex side's toroidal electromagnetic field (26).

Operational considerations will entail precisely timed energizing of the aforementioned series of components. Once said representation of the first embodiment (10) is energized it will produce a basin-formed electromagnetic field (20) in which a compressed electromagnetic hemisphere (22) is generated just above the basin-formed scaffold's aperture (102). Said hemisphere further produces an electromagnetic pressure at said hemisphere's cap (24) giving electromagnetic forward flow momentum just as the ferrous material or projectile is influenced to reach the first said electromagnetic pressure cap (24) of the basin-formed electromagnetic field (20). The embodiments are energized in sequence as the ferrous material or projectile travels down the conduit and crosses into the generator's electromagnetic fields of influence further accelerating as well as rotating said ferrous material or projectile's up to but not limited to or by high-hypersonic velocity.

The embodiments of the aforementioned invention may be reconfigured without departing from the spirit and scope of the inventive core. Such as the size of the embodiments, varied shape of the embodiments but also the amount of or shape of electromagnetic coils and corresponding mounting slots as well as the number of, shape of, size of and installation order of the rotational electromagnetic field generators and basin-formed electromagnetic field generators. Configuration and energy levels of heretofore embodiments may be reliant on the intention of one skilled in the art as to the desired outcome for velocity and accuracy.

Achieving extremely high-hypersonic velocities has been a goal of many military and civilian organizations. However, all designs thus far have not quite reached that level or beyond the velocities desired by this field. Therefore what is needed is a new apparatus to achieve said velocities.

This process of previously mentioned embodiments interaction, activation in sequence is to be repeated as often, but not limited to or by, aforementioned configurations, and at high enough electrical power levels as needed to achieve the desired outcome of ferrous material, matter, or projectile velocity and accuracy up to, including or beyond, high-hypersonic velocities. It will be apparent to one skilled in the art that high-hypersonic and other desired velocities may be achieved using some or all of the mentioned components, system, and methods without departing from the spirit and scope of the present invention. It will also be apparent to the skilled artisan that the aforementioned embodiments are specific examples of a single broader invention which may have greater scope than any of the singular descriptions taught. There may be many alterations made in the descriptions without departing from the spirit and scope of the present invention.

SUMMARY

The Hyper-Magnetic Matter Accelerator is an electromagnetic launcher apparatus and method for accelerating ferrous material or matter to extremely high velocity and achieving but is not limited to or by, high-hypersonic velocities in said ferrous material, matter, as well as projectiles which includes a method for achieving electromagnetic rotational motion stabilization for trajectory accuracy which will address the need for a much higher velocity in electromagnetic launchers.

Figure 1:
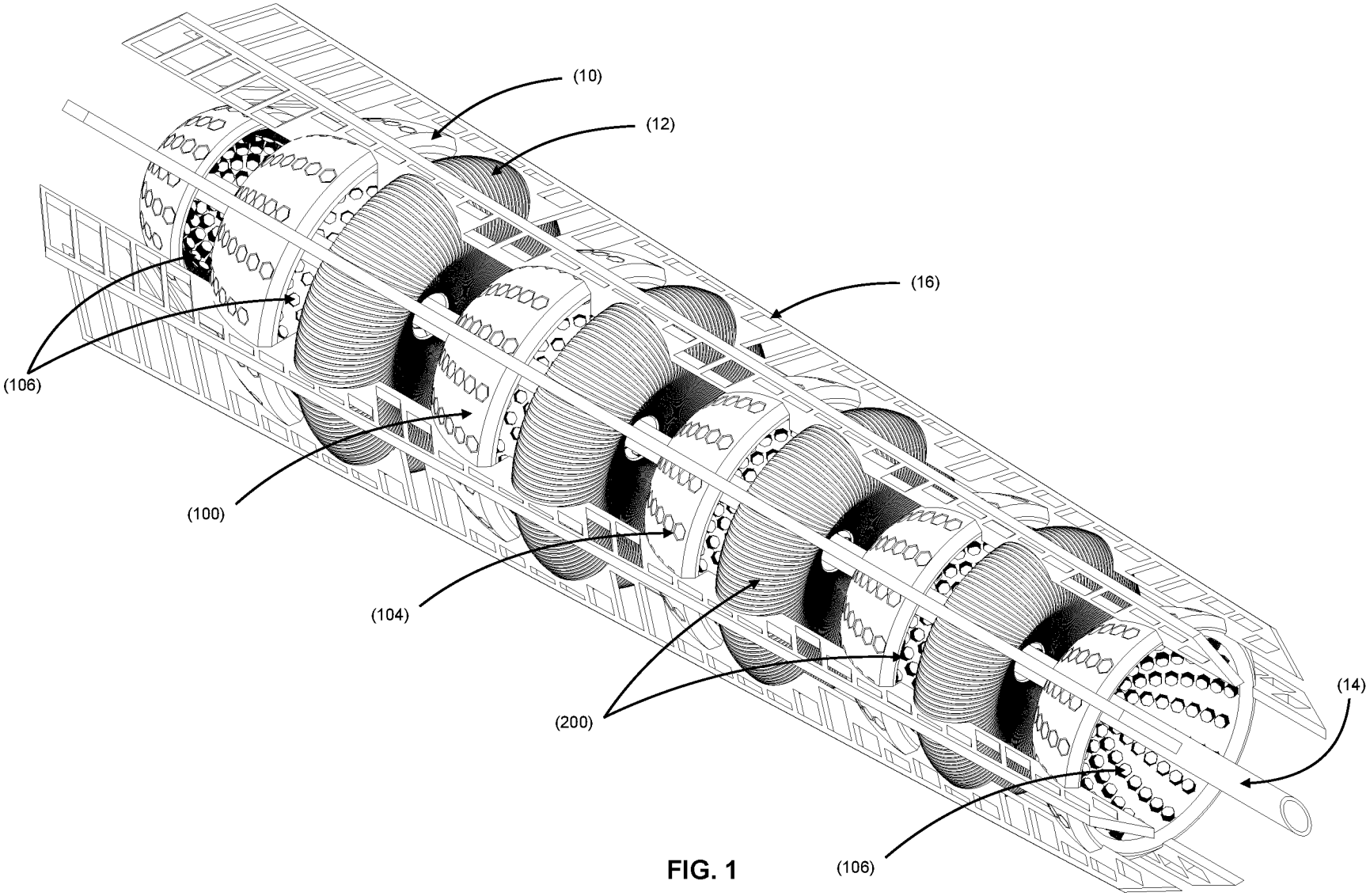
FIG. 1 is an isometric northwest perspective view of the Hyper-Magnetic Matter Accelerator assembled as an exemplary embodiment of the present invention
Figure 2:
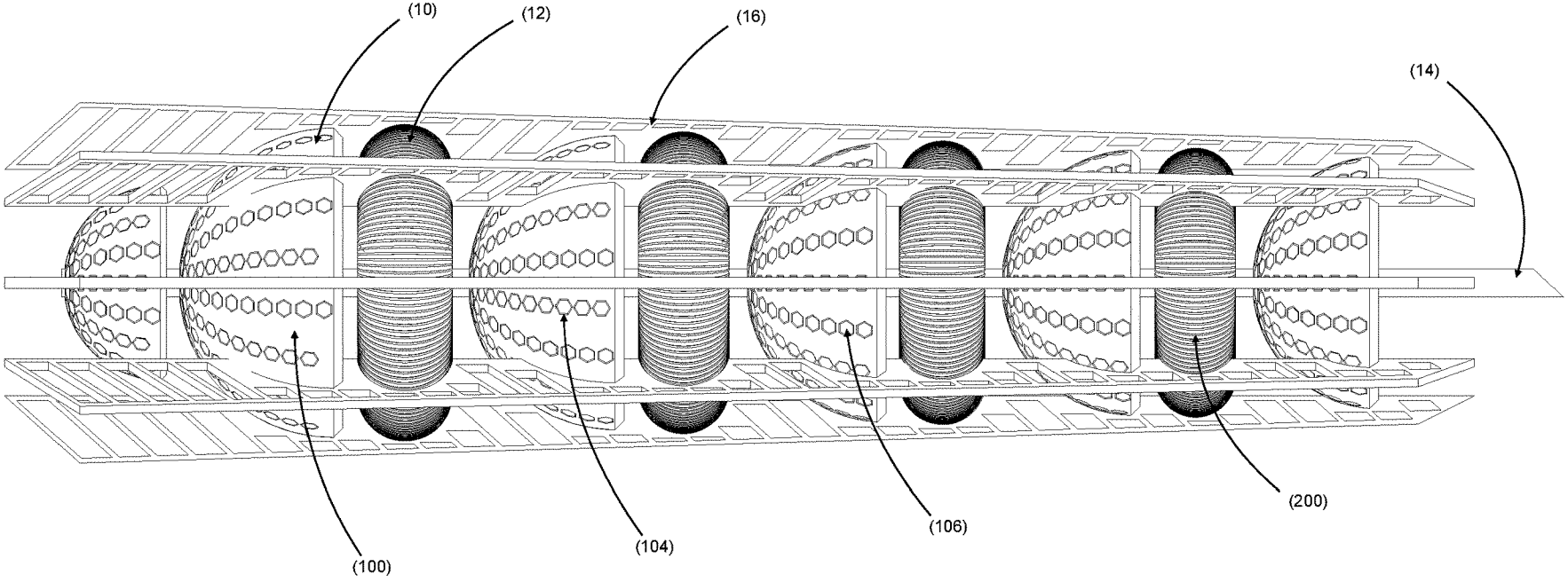
FIG. 2 is a left view of the Hyper-Magnetic Matter Accelerator
Figure 3:
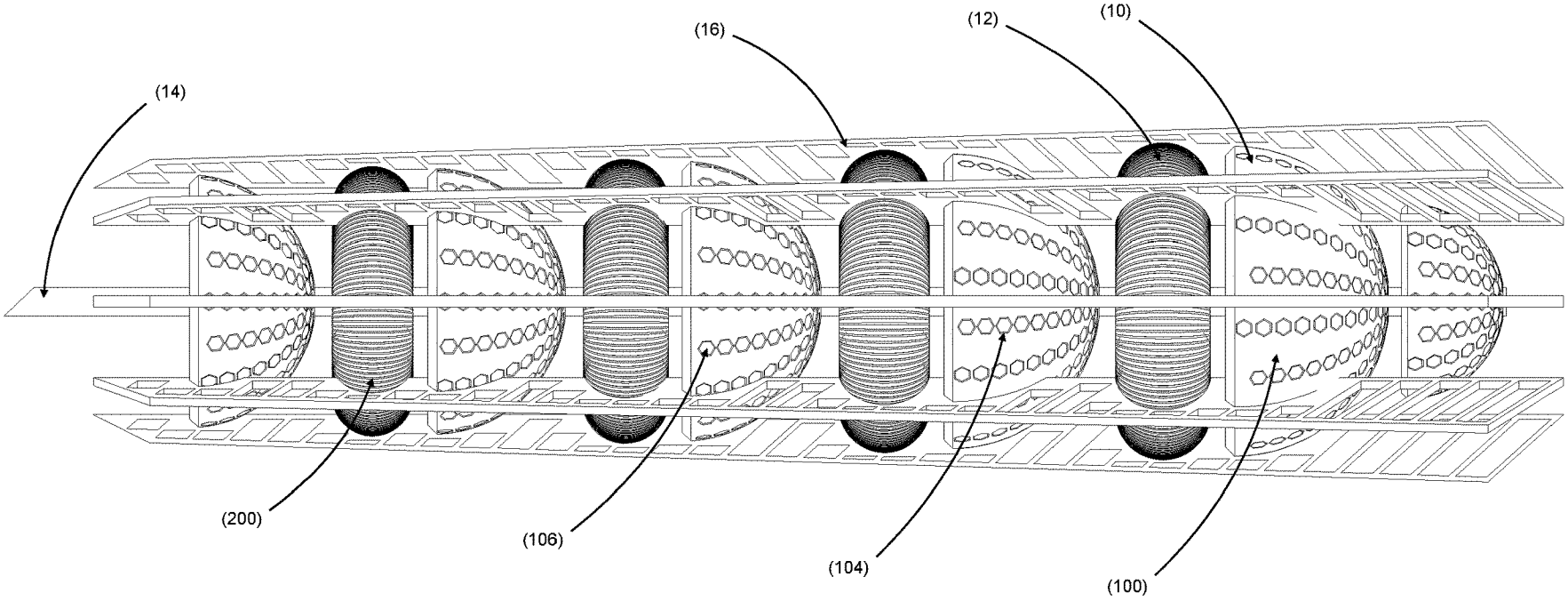
FIG. 3 is a right view of the Hyper-Magnetic Matter Accelerator
Figure 4:
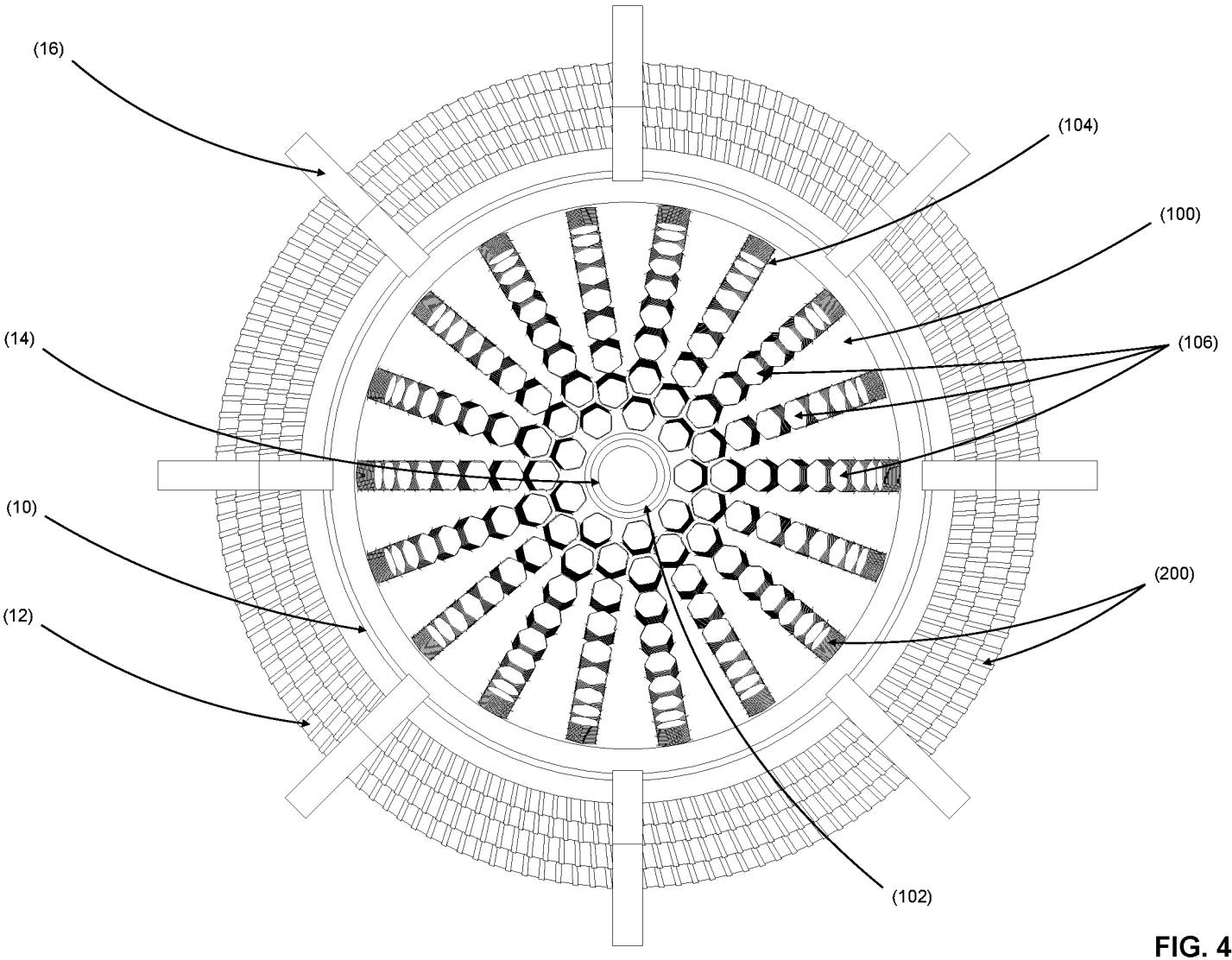
FIG. 4 is a front view of the Hyper-Magnetic Matter Accelerator
Figure 5:
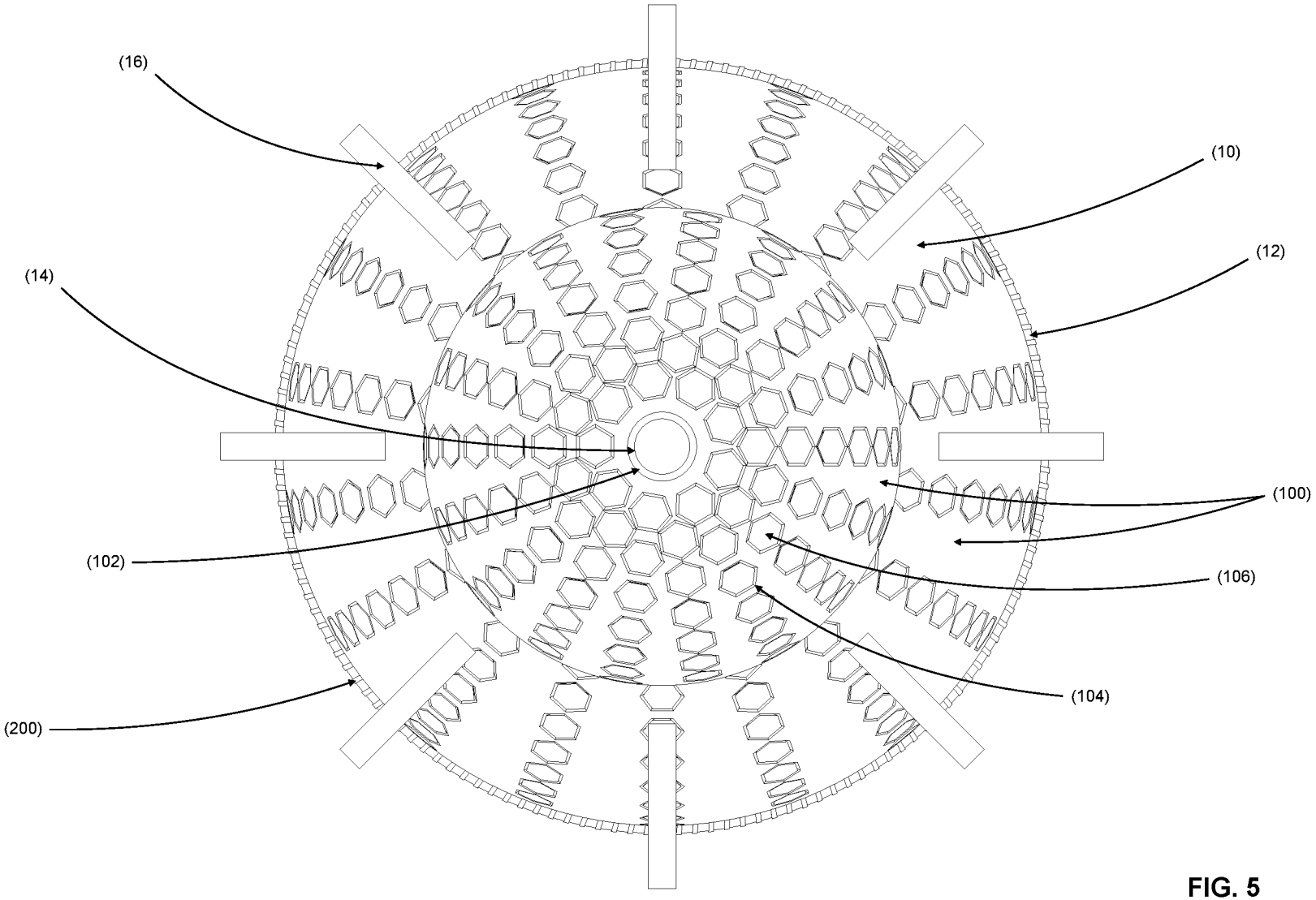
FIG. 5 is a rear view of the Hyper-Magnetic Matter Accelerator
Figure 6:
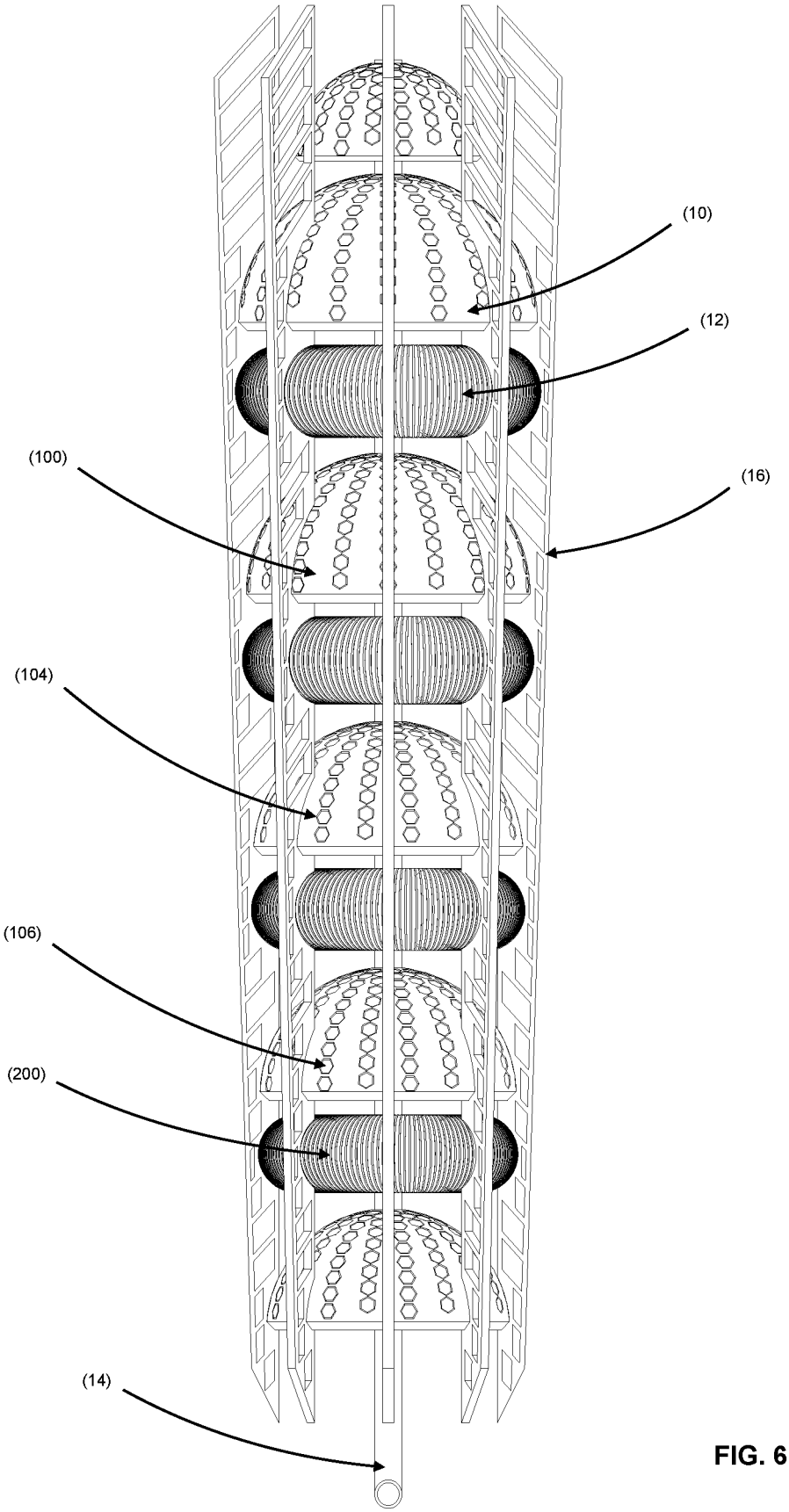
FIG. 6 is a top view of the Hyper-Magnetic Matter Accelerator
Figure 7:
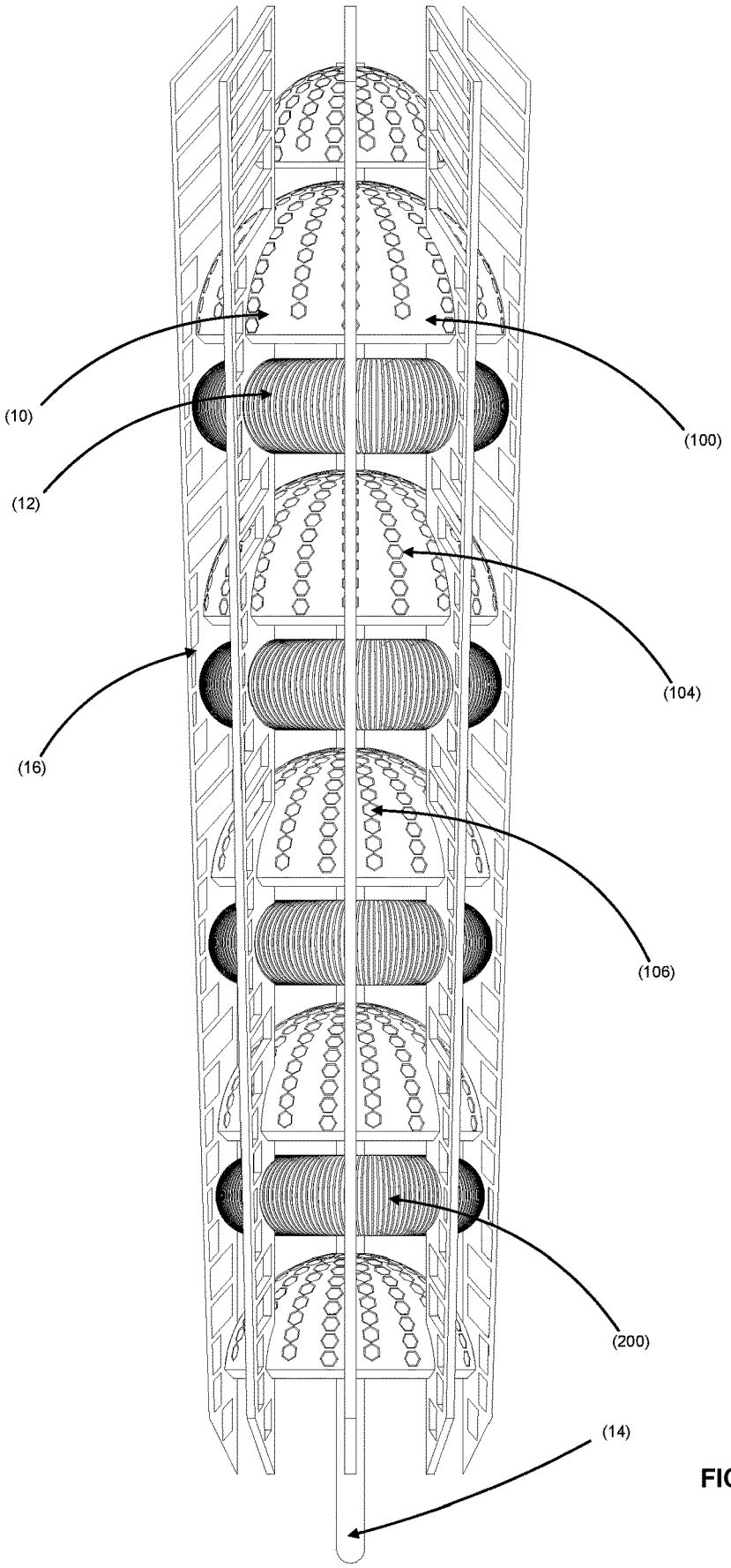
FIG. 7 is a bottom view of the Hyper-Magnetic Matter Accelerator
Figure 8:
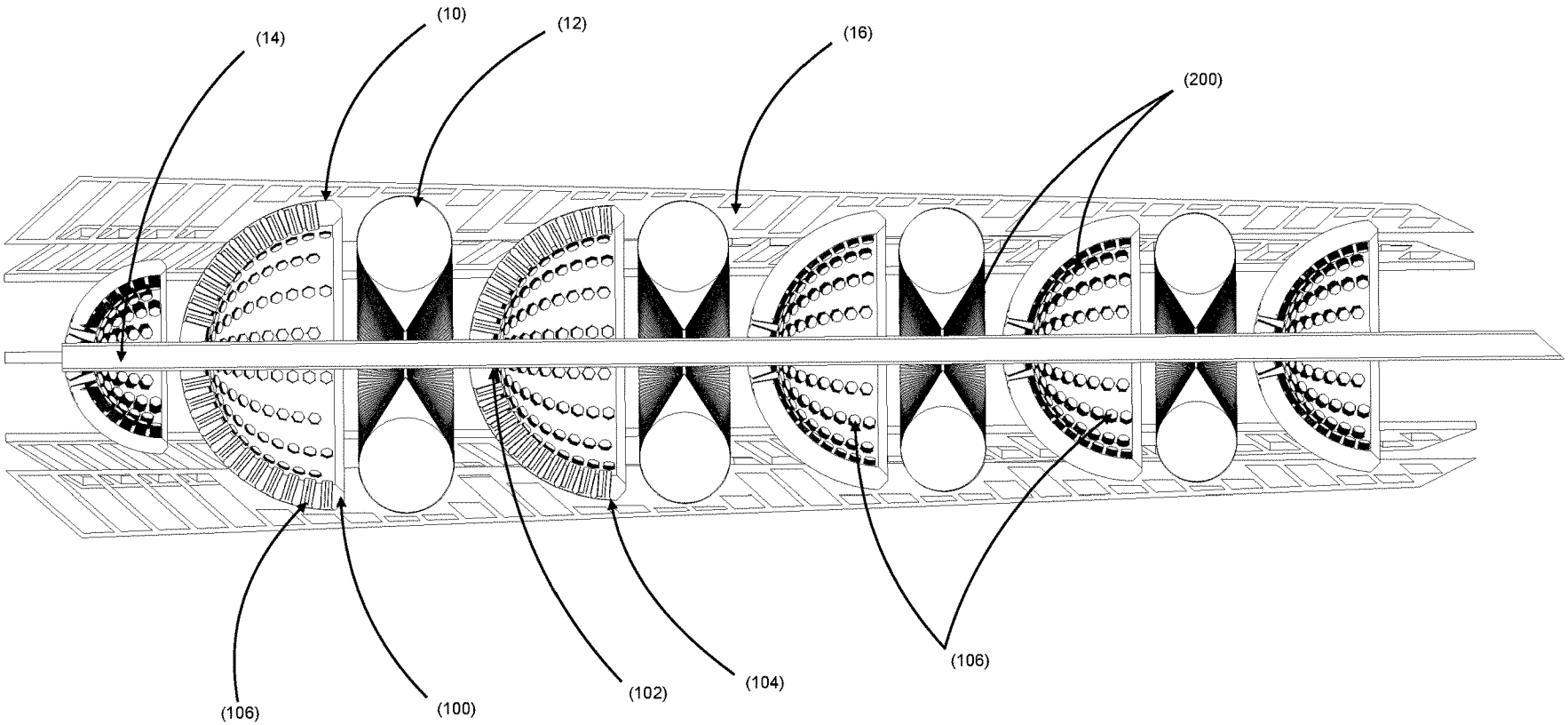
FIG. 8 is a sectional left view of the Hyper-Magnetic Matter Accelerator
Figure 9:
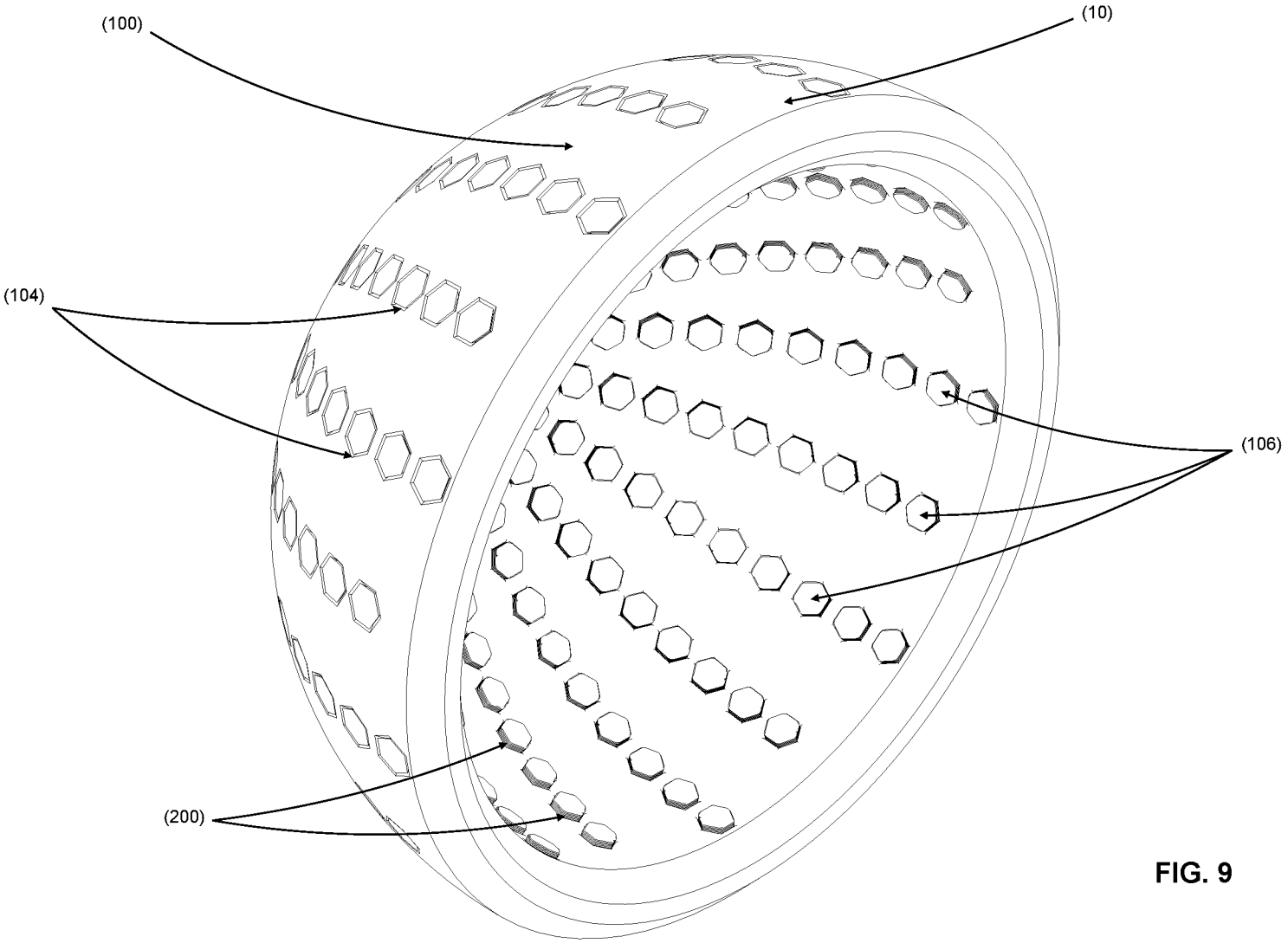
FIG. 9 is an isometric northwest perspective view of the Basin-Formed Electromagnetic Field Generator
Figure 10:
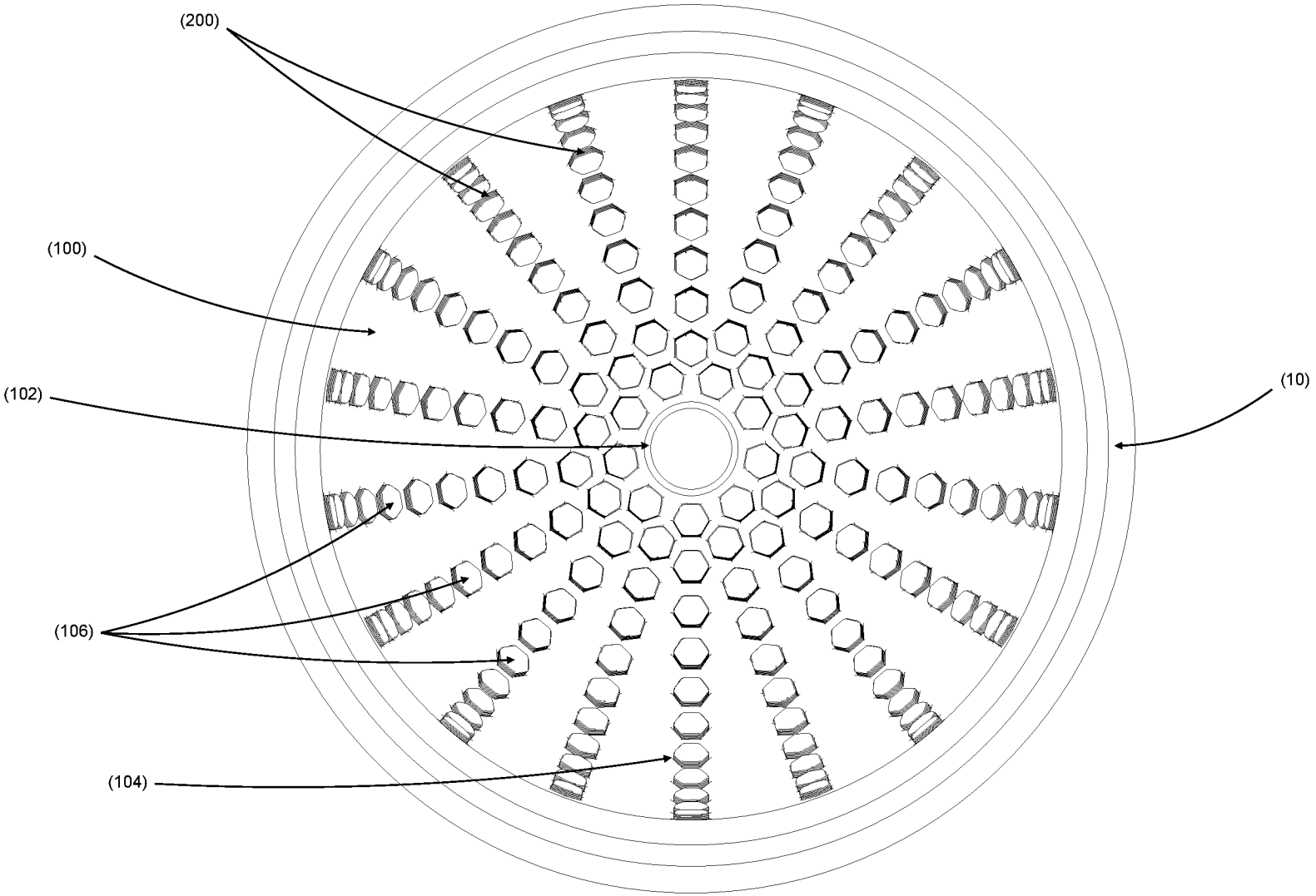
FIG. 10 is a front view of the Basin-Formed Electromagnetic Field Generator
Figure 11:
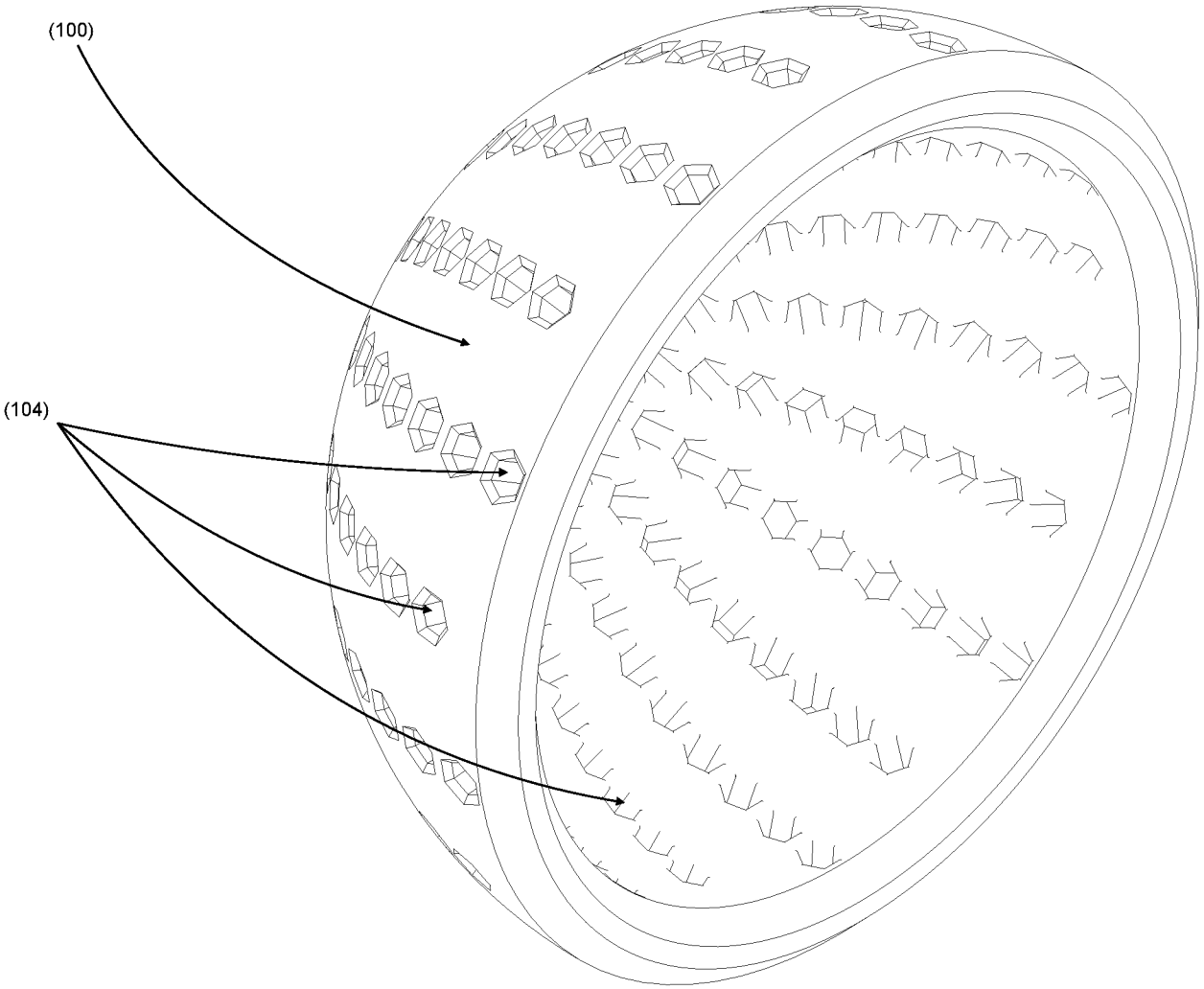
FIG. 11 is an isometric northwest perspective view of the Basin-Formed Mounting Scaffold without electromagnetic coils installed
Figure 12:
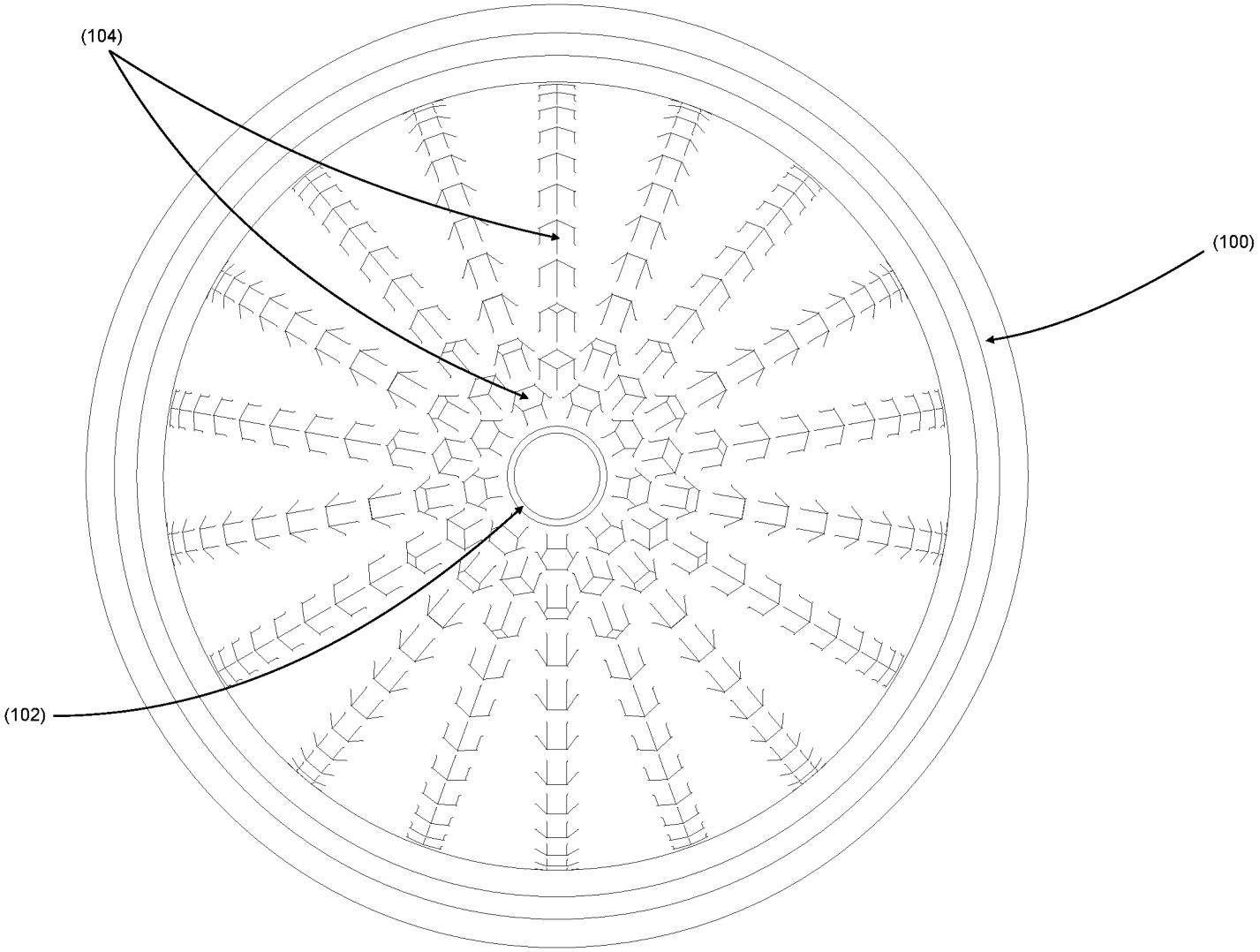
FIG. 12 is a front-perspective view of the Basin-Formed Mounting Scaffold without electromagnetic coils installed
Figure 13:
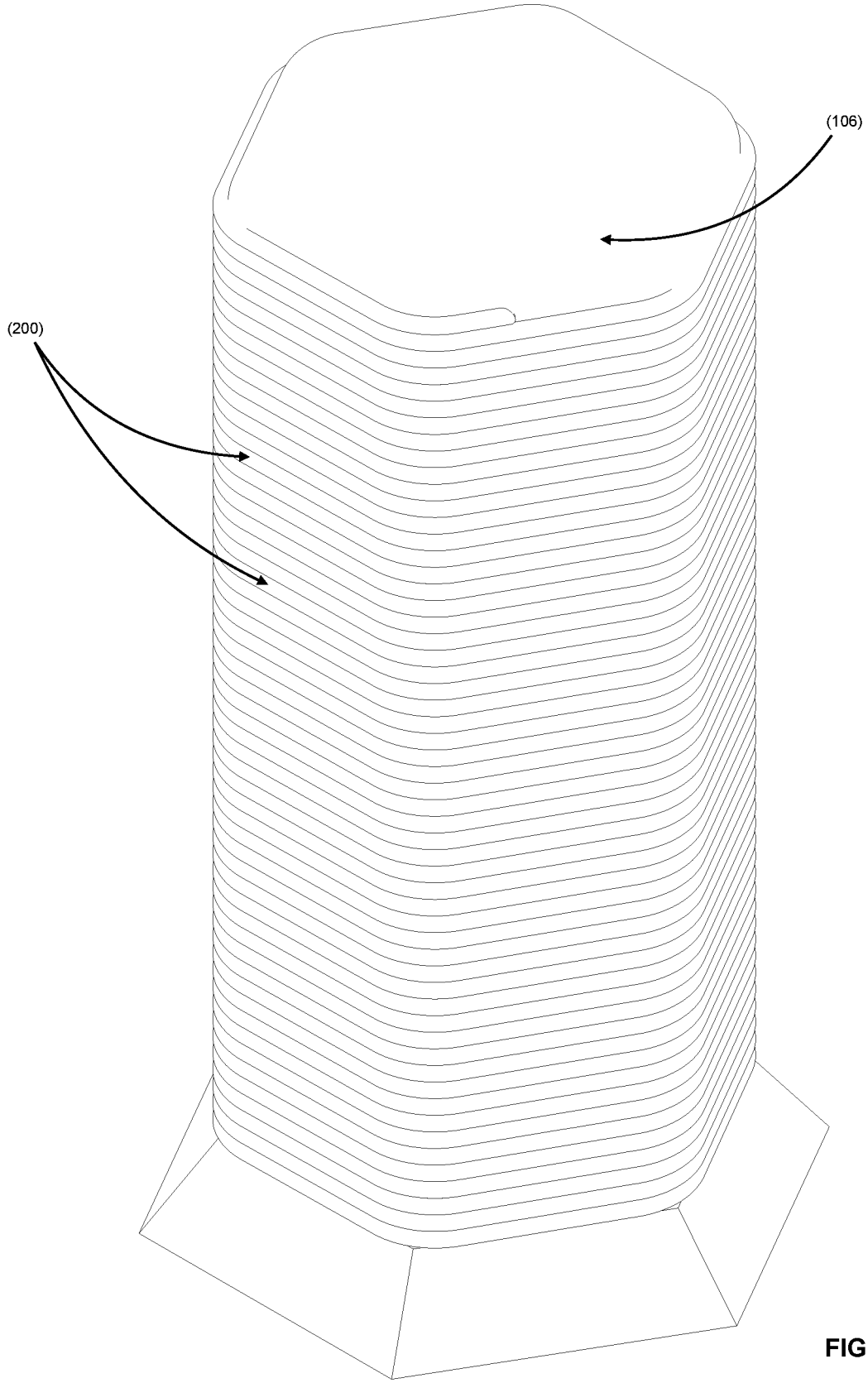
FIG. 13 is an isometric northwest perspective view of an exemplary Electromagnetic Coil
Figure 14:
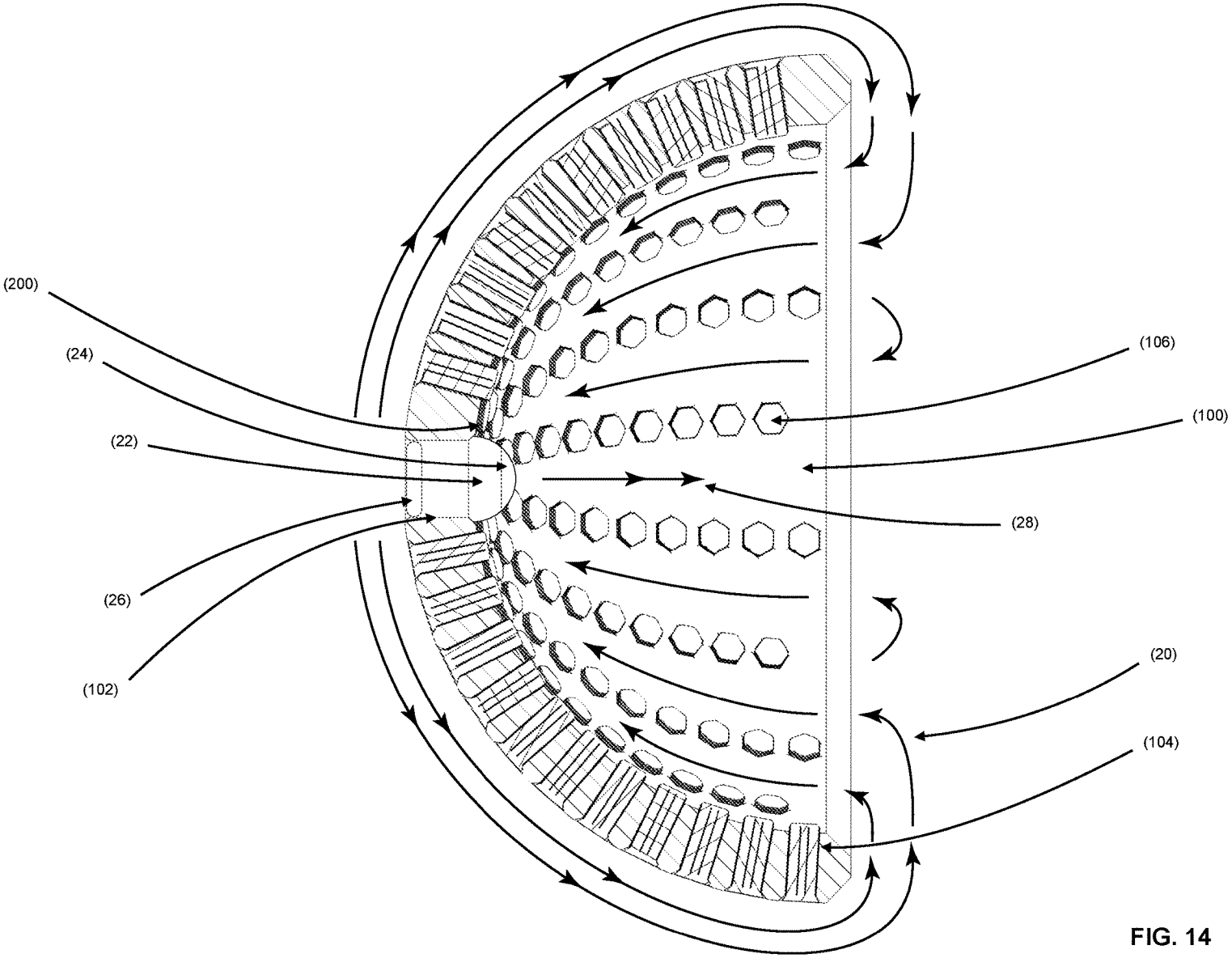
FIG. 14 is a sectional left view of the Basin-Formed Electromagnetic Field Generator with illustrated electromagnetic field lines as well as directional arrows and aforementioned electromagnetic acceleration structures
Figure 15:
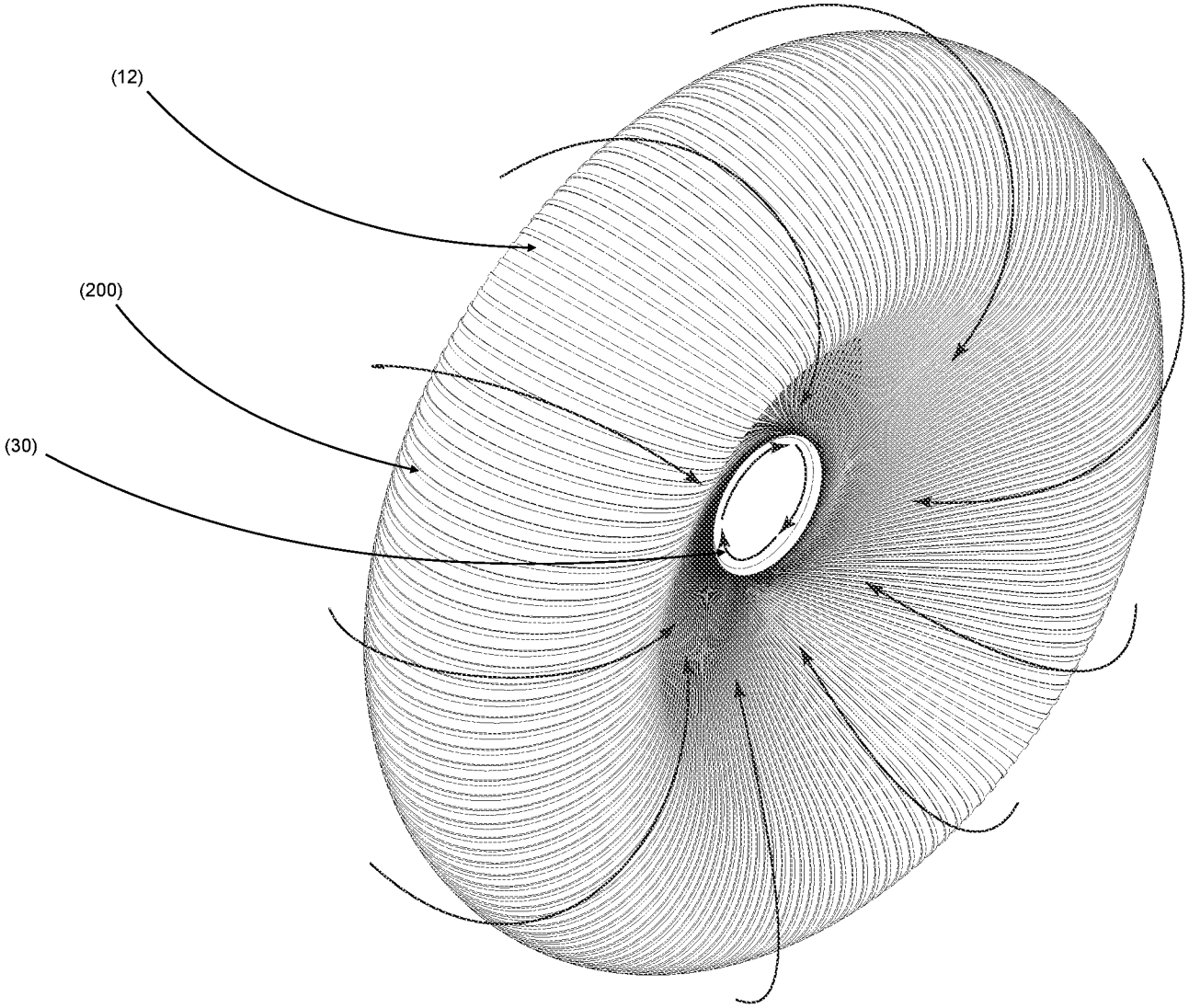
FIG. 15 is an isometric northwest perspective view of an exemplary rotational electromagnetic field generator with illustrated electromagnetic field lines indicated with electromagnetic field directional arrows.

The invention claimed is:

1. A method of using an electromagnetic launcher comprising of an apparatus and system of basin-formed electromagnetic field generators working in tandem with rotational electromagnetic field generators which may be mounted alternating in series, encircling a conduit and bracketed with thermal railing; energized in sequence for ferrous material, matter or at least one projectile's forward acceleration to, but not limited to or by, high-hypersonic velocity and rotation for trajectory stabilization and accuracy using also a described method further comprising;

(a) an embodiment wherein:
a basin-formed scaffold, which has an aperture at said basin-formed scaffold's base, also includes a radial pattern plurality of mounting slots on all sloping sides of said basin-formed scaffold's wall;

(b) a plurality of conductive wire-wrapped electromagnetic coils installed lengthwise perpendicular in relation to the outer basin surface into said mounting slots of said basin-formed scaffold;

(c) said electromagnetic coils are oriented so that all electromagnetic north or south poles point to the center of the shallowest point of said basin-formed scaffold's open area;

(d) said basin-formed scaffold in tandem with said electromagnetic coils, once energized and oriented in the previously mentioned fashion, creates a basin-formed electromagnetic field in which is generated a compressed electromagnetic hemisphere just above said basin-formed scaffold's base and aperture's rim, hereinafter referred to as basin-formed electromagnetic field generator;

(e) said compressed electromagnetic hemisphere's apex region consists of the highest point of condensed electromagnetic pressure and forward momentum electromagnetic force;

(f) said electromagnetic forward momentum force produces the forward momentum in ferrous material, matter or at least one projectile;

(g) said plurality of basin-formed electromagnetic field generators also form a toroid-shaped electromagnetic field below said basin-formed scaffold's base producing electromagnetic force (h) an embodiment wherein:
conductive wire is structured and wound to form at least one electromagnetic coil that generates a rotating electromagnetic field, and once energized, physically rotates ferrous material or at least one projectile on their longitudinal axis to attain spin stabilization for flight accuracy;

(i) a method in which:
said ferrous material, matter or at least one projectile are acted upon to reach a first basin-formed electromagnetic field generator;

(j) said plurality of basin-formed electromagnetic field generators are is timed to be energized just as said ferrous material, matter or at least one projectile are crossing into the electromagnetically compressed hemisphere's apex region giving initial forward momentum;

(k) a proceeding basin-formed electromagnetic field generator is energized just as said ferrous material, matter or at least one projectile are crossing into it's electromagnetically compressed hemisphere's apex region giving further momentum;

(l) said ferrous material, matter or at least one projectile are then acted upon by a rotational electromagnetic field generator timed to be energized just as said ferrous material, matter or at least one projectile are entering said rotational electromagnetic field generator's area of influence giving rotation;

(m) another proceeding basin-formed electromagnetic field generator is timed to be energized just as said ferrous material, matter or at least one projectile are crossing into said basin-formed electromagnetic field generator's compressed electromagnetic hemisphere's apex region giving even further forward momentum acceleration;

(n) said plurality of basin-formed electromagnetic field generators may be oriented with their convex or concave sides facing forward, however, concave gives more forward electromagnetic force as the electromagnetic hemisphere's apex region gives more forward force than the toroidal convex electromagnetic force.

* * * * *